United States Patent [19]

Matsumura et al.

[11] 4,293,336

[45] Oct. 6, 1981

[54] COLD ROLLED NON-ORIENTED ELECTRICAL STEEL SHEET

[75] Inventors: Ko Matsumura, Ichihara; Hiroto Nakamura; Toshio Irie, both of Chiba, all of Japan

[73] Assignee: Kawasaki Steel Corporation, Kobe, Japan

[21] Appl. No.: 153,029

[22] Filed: May 27, 1980

[30] Foreign Application Priority Data

May 30, 1979 [JP] Japan ..... 54-66087

[51] Int. Cl.[3] ..... C22C 38/06

[52] U.S. Cl. ..... 75/124; 75/123 A; 75/123 L; 148/31.55

[58] Field of Search ..... 75/124 B, 124 E, 123 A, 75/123 L; 148/31.55

[56] References Cited

U.S. PATENT DOCUMENTS

| | | | |
|---|---|---|---|
| 2,056,591 | 10/1936 | Schulz et al. | 75/123 A |
| 2,867,531 | 1/1959 | Holzwarth et al. | 75/124 |
| 3,239,332 | 3/1966 | Goss | 75/123 L |
| 3,853,544 | 12/1974 | Nishi et al. | 75/123 A |
| 4,123,299 | 10/1978 | Fiedler et al. | 75/123 L |

*Primary Examiner*—L. Dewayne Rutledge
*Assistant Examiner*—John P. Sheehan
*Attorney, Agent, or Firm*—Balogh, Osann, Kramer, Dvorak, Genova & Traub

[57] ABSTRACT

A cold rolled non-oriented electrical steel sheet having a low iron loss is disclosed. The steel sheet consists of not more than 0.02% of C, 0.1–3.5% of Si, not more than 1.0% of Al, 0.1–1.0% of Mn, 0.03–0.40% of Sn and the remainder being substantially Fe.

1 Claim, 1 Drawing Figure

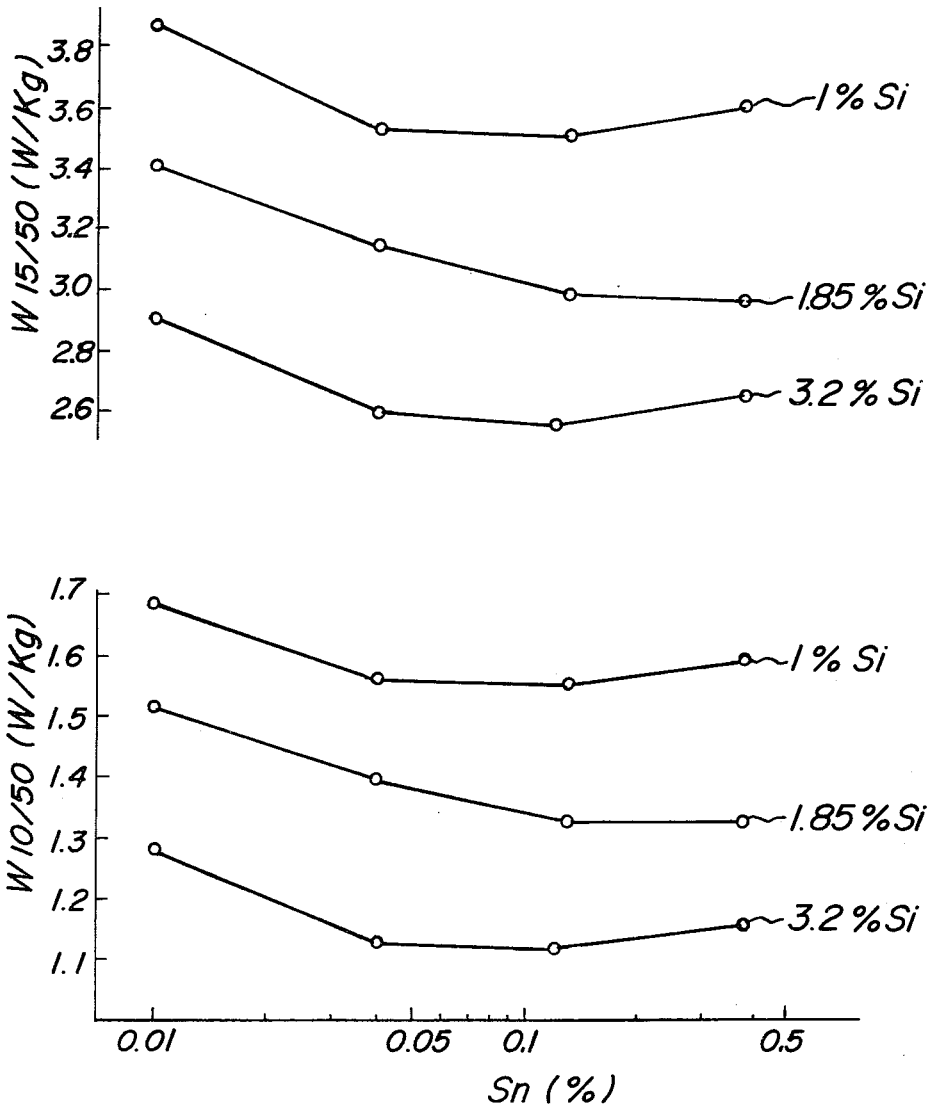
W 15/50 (W/Kg)
3.8
3.6
3.4
3.2
3.0
2.8
2.6
1% Si
1.85% Si
3.2% Si
W 10/50 (W/Kg)
1.7
1.6
1.5
1.4
1.3
1.2
1.1
1% Si
1.85% Si
3.2% Si
0.01
0.05
0.1
0.5
Sn (%)

COLD ROLLED NON-ORIENTED ELECTRICAL STEEL SHEET

BACKGROUND OF THE INVENTION (1) Field of the Invention

The present invention relates to a non-oriented electrical steel sheet, and more particularly relates to a cold rolled non-oriented electrical steel sheet having a low iron loss.

(2) Description of the Prior Art

Non-oriented electrical steel sheets are graded by their iron loss. For example, in the JIS, non-oriented electrical steel sheets having a thickness of 0.050 mm are graded as follows. In the S-30 grade steel sheet, $W_{10/50}$ must be not higher than 3.70 W/kg and $W_{15/50}$ must be not higher than 8.00 W/kg; and in the S-10 grade steel sheet, $W_{10/50}$ must be not higher than 1.25 W/kg and $W_{15/50}$ must be not higher than 3.10 W/kg.

The iron loss of non-oriented silicon steel sheets is occupied by the hysteresis loss rather than by the eddycurrent loss contrary to the iron loss of oriented electrical steel sheets, and the hysteresis loss occupies generally 60–80% of the total iron loss. The hysteresis loss is in inverse proportion to the crystal grain size. It is an effective means to promote the normal grain growth of recrystallized grains at the final annealing in order to decrease the iron loss, and this means has hitherto been always used in order to lower the iron loss.

The inventors have newly found out that the alloying of Sn to non-oriented silicon steel sheet is effective for lowering the iron loss thereof, and have accomplished the present invention.

SUMMARY OF THE INVENTION

The feature of the present invention is the provision of a cold rolled non-oriented electrical steel sheet having a low iron loss, which consists of not more than 0.02% by weight of C, 0.0–3.5% by weight of Si, not more than 1.0% by weight of Al, 0.1–1.0% by weight of Mn, 0.03–0.40% by weight of Sn and the remainder being substantially Fe.

BRIEF DESCRIPTION OF A DRAWING

The single FIGURE is a graph showing a relation between the Sn content in an electrical sheet having an Si content of 1% by weight (hereinafter, % means % by weight), 1.85% or 3.2% and the iron loss thereof.

DESCRIPTION OF THE PREFERRED EMBODIMENT

The present invention will be explained in more detail.

There has hitherto been hardly known the influence of Sn upon the magnetic property of non-oriented electrical steel sheet. After various investigations, the inventors have found out that Sn is remarkably effective for lowering the iron loss of non-oriented electrical steel sheet as illustrated in the following data.

The single FIGURE of the drawing shows the results of measurement of iron losses of Epstein samples produced by subjecting hot rolled sheets having different contents of each of Si and Sn as shown in the following Table 1 to a one-stage cold rolling to prepare cold rolled sheets having a final gauge of 0.5 mm, and then subjecting the cold rolled sheets to a continuous annealing under a dry hydrogen atmosphere kept at 950° C.

It can be seen from Table 1 and the Figure that the addition of Sn to silicon steel sheet is effective for the production of electrical steel sheet having a low iron loss.

TABLE 1

| Sample No. | C (%) | Si (%) | Mn (%) | S (%) | Al (%) | Sn (%) |
|---|---|---|---|---|---|---|
| 1 | 0.002 | 1.01 | 0.29 | 0.004 | 0.27 | 0.01 |
| 2 | 0.004 | 1.02 | 0.29 | 0.003 | 0.28 | 0.04 |
| 3 | 0.002 | 1.01 | 0.29 | 0.004 | 0.27 | 0.13 |
| 4 | 0.004 | 1.02 | 0.29 | 0.005 | 0.28 | 0.38 |
| 5 | 0.004 | 1.85 | 0.30 | 0.003 | 0.28 | 0.01 |
| 6 | 0.005 | 1.85 | 0.30 | 0.003 | 0.29 | 0.04 |
| 7 | 0.004 | 1.85 | 0.30 | 0.003 | 0.28 | 0.13 |
| 8 | 0.005 | 1.85 | 0.30 | 0.003 | 0.29 | 0.38 |
| 9 | 0.006 | 3.20 | 0.29 | 0.002 | 0.29 | 0.01 |
| 10 | 0.007 | 3.20 | 0.29 | 0.003 | 0.29 | 0.04 |
| 11 | 0.006 | 3.20 | 0.29 | 0.003 | 0.29 | 0.12 |
| 12 | 0.007 | 3.20 | 0.29 | 0.002 | 0.29 | 0.40 |

The reason of the limitation of the composition of the non-oriented electrical steel of the present invention will be explained hereinafter.

When a silicon steel sheet contains less than 0.03% of Sn, the effect of Sn for lowering the iron loss of the resulting electrical steel sheet does not appear. While, when a silicon steel sheet contains more than 0.40% of Sn, the Steel sheet cracks during the cold rolling. Therefore, the Sn content in the silicon steel sheet of the present invention should be within the range of 0.03–0.40%.

When, the C content in a silicon steel sheet is more than 0.02%, the magnetic property of the resulting electrical steel sheet is poor. Therefore, the C content in a silicon steel sheet of the present invention should be not more than 0.02%.

Si serves to increase the specific resistivity and to lower the iron loss of steel sheet. When the Si content in a steel sheet is more than 3.5%, the steel sheet is brittle and cannot be cold rolled. In rimmed steel, the effect of Sn does not appear. When, a steel sheet contains not less than 0.1% of Si, the steel sheet has an improved aggregation texture. Therefore, the Si content in the steel sheet of the present invention should be within the range of 0.1–3.5%.

Al serves to improve the magnetic property of silicon steel sheet. When a silicon steel sheet contains more than 1.0 % of Al, the steel sheet is apt to crack. Therefore, the Al content in the silicon steel sheet of the present invention should be not more than 1.0%.

Mn serves to prevent the crack of silicon steel sheet during the hot rolling. When the Mn content in a silicon steel sheet is less than 0.1%, the above described crack cannot be prevented. While, when the Mn content exceeds 1.0%, the magnetic property of the resulting electrical steel sheet is poor. Therefore, the Mn content in the silicon steel sheet of the present invention should be within the range of 0.1–1.0%.

Then, a method of producing the cold rolled non-oriented electrical steel sheet of the present invention will be explained.

The starting steel to be used in the present invention can be produced by means of any of commonly known open hearth furnace, converter and electrical furnace. Then, the starting steel may be subjected to a vacuum degassing treatment or a ladle refining treatment. Sn may be added to the molten steel in a ladle or to the molten steel at the pouring thereof into a casting mold or into a continuous casting system mold. However, it is necessary that the solidified steel ingot or slab has the above described composition. A steel ingot or slab obtained in the above described method is hot rolled by a commonly known hot rolling method. The hot rolled sheet is pickled, after annealing or without annealing, to remove oxide scale and then cold rolled. The cold rolling may be carried out by an one-stage cold rolling or a two-stage cold rollings with an intermediate annealing, whereby a cold rolled sheet having a final gauge is produced. The cold rolled sheet is then subjected to a continuous annealing to produce a final product. Alternatively, the cold rolled sheet is sold in the market as a semi-processed product. An electric apparatus manufacturer punches the cold rolled sheet into a desired shape and then carries out a stress-relief annealing to produce a final product.

The following example is given for the purpose of illustration of this invention and is not intended as a limitation thereof.

EXAMPLE

A hot rolled sheet having a thickness of 2 mm, which consists of 0.004% of C, 0.32% of Si, 0.31% of Mn, 0.005% of S, 0.27% of Al, 0.04% of Sn and the remainder being substantially iron, was pickled, and subjected to a one-stage cold rolling to produce a cold rolled sheet having a final gauge of 0.5 mm. The cold rolled sheet was continuously annealed for 3 minutes under a dry hydrogen atmosphere kept at 950° C. An Epstein test piece was cut out from the finally annealed sheet, and the electromagnetic property of the test piece was measured. The steel sheet had a very excellent electromagnetic property of $W_{10/50}$ of 2.65 W/kg, $W_{15/50}$ of 5.90 W/kg and $B_{50}$ of 1.76 T.

What is claimed is:

1. A cold rolled non-oriented electrical steel sheet having a low iron loss, which consists of not more than 0.02% by weight of C, 0.1–3.5% by weight of Si, not more than 1.0% by weight of Al, 0.1–1.0% by weight of Mn, 0.03–0.40% by weight of Sn and the remainder being essentially iron.

* * * * *